US005645245A

United States Patent [19]

Kremar

[11] Patent Number: 5,645,245

[45] Date of Patent: Jul. 8, 1997

[54] CENTER WIND ASSIST DRIVING WHEEL MECHANISM

[76] Inventor: Djuro Kremar, #31-40th Ave., Notre Dame, Ile Perrot Quebec J7V 5X8, Canada

[21] Appl. No.: 513,125

[22] Filed: Aug. 9, 1995

[30] Foreign Application Priority Data

May 25, 1995 [CA] Canada ..... 2150168

[51] Int. Cl.[6] ..... B65H 18/14; B65H 18/26

[52] U.S. Cl. ..... 242/541.1; 242/542.3

[58] Field of Search ..... 242/541.1, 542.3

[56] References Cited

U.S. PATENT DOCUMENTS

| | | | |
|---|---|---|---|
| 2,865,264 | 12/1958 | Moser | 93/58.2 |
| 4,358,066 | 11/1982 | Deutschle et al. | 242/68.4 |
| 4,540,131 | 9/1985 | Ishii et al. | 242/55 |
| 4,711,404 | 12/1987 | Falk | 242/542.3 X |
| 5,064,131 | 11/1991 | Van Biesen et al. | 242/541.1 |
| 5,069,394 | 12/1991 | Panttila et al. | 242/67.1 |
| 5,083,719 | 1/1992 | Kremar | 242/65 |
| 5,375,790 | 12/1994 | Svangvist | 242/542.3 X |

FOREIGN PATENT DOCUMENTS

| | | | |
|---|---|---|---|
| 1254872 | 5/1989 | Canada | 242/44.3 |
| 2054250 | 10/1991 | Canada . | |
| 2054249 | 10/1991 | Canada . | |
| 1321181 | 8/1993 | Canada | 242/38 |
| 94/24033 | 10/1994 | WIPO | 242/541.1 |

*Primary Examiner*—John Q. Nguyen

[57] ABSTRACT

A center wind assist mechanism for use in a web winding device for winding a substantially continuous web onto a reel bar. The winding device incudes a driving drum that maintains a first nip engagement with the reel bar to rotate the reel bar and transfer the web passing over a surface of the driving drum onto the reel bar. The web winding device further includes a transfer mechanism for moving the reel bar from a primary winding position to a secondary winding position while maintaining the reel bar in nip driving engagement with the driving drum. The web winding device is characterized by a center wind assist mechanism for applying a driving torque to the reel bar as the reel bar moves from the primary winding position to the secondary winding position. The center assist winding mechanism includes a drive assist support arm pivotally mounted to the transfer mechanism to move therewith and pivot relative thereto. A driving wheel is rotatably connected the drive assist support arm. A drive mechanism and transmission mechanism cooperate to rotatably drive the driving wheel. A tensioning mechanism is connected to the transfer mechanism to maintain the driving wheel in driving and torque transfer relation with a peripheral surface portion of the reel bar. The center assist drive mechanism insures a more distributed nip pressure being applied across the web passing between the reel bar and winding drum during this initial phase of winding.

7 Claims, 4 Drawing Sheets

CENTER WIND ASSIST DRIVING WHEEL MECHANISM

FIELD OF THE INVENTION

The present invention relates to a center wind assist winding mechanism for use in a web winding device of a paper making machine wherein a continuous web of paper may be wound onto a reel bar.

BACKGROUND OF THE INVENTION

Paper-making typically involves forming, pressing, drying and reeling of a paper web passing through the paper machine. Current day paper-making machines operate at high speed and reel bars provided in the winding section of the machine must maintain an uninterrupted winding of the web onto the reel bar.

The reel bar contacts through nip engagement a driving drum and is driven by this engagement so that the paper web passing in contact with the driving drum is wound onto the reel bar. The reel bar usually is supported on rails during the reeling operation. Tension is provided to the web by running the driving drum faster than the speed of the previous section of the paper-making machine. The tension and nip pressure can be varied to produce rolls of paper with a desired tightness.

To maintain uninterrupted winding, a new reel bar is usually supported above the winding section of the machine as the paper is wound onto a second reel bar supported on the rails. As the paper on the second wound reel bar reaches a full or wound condition, rotation of the new reel bar is started to bring the new reel bar up to a speed that will allow it to receive the paper web. The new reel bar is then lowered into nip driving engagement with the driving drum and the paper is cut so that the paper now winds onto the new reel bar. This initial winding position for the new reel bar is referred to as the primary winding position. The wound second reel bar supported on the rails is referred to as the secondary winding position. The second wound reel bar is then moved down the rails away from the winder, rotation is halted, and the wound second reel bar is removed from the rails.

Next, the new reel bar is moved or rotated about the winding drum from the primary winding position to the secondary winding position. During this rotation, the reel bar is maintained in nip driving engagement with the driving drum by a transfer arm mechanism. Once the reel bar reaches the secondary winding position, the reel bar is usually supported on rails and another arm maintains the reel bar in nip driving engagement with the driving drum. This permits the transfer arm mechanism to release the reel bar and move back to its initial position to receive a new reel bar.

This form of winding with the driving drum contacting the reel bar has a tendency to have an uneven nip pressure over the width of the web. This is usually due to roll deflection. Roll deflection effects the tension of the web wound onto the reel bar and is more severe when the web being reeled is recycled. With environmental concerns, an increased usage of recycled paper has occurred. Recycled paper includes a wide variety of paper products and the incorporation of recycled fiber in newsprint and other paper furnishes.

Accordingly, it is believed that the use of a center wind assist mechanism in the reeling/winding operation will result in a more even winding tension to the reel bar. While center assist winding is known in the art, it is believed that the center assist winding device of the present invention provides a novel structure that results in an even tension being provided to the web wound onto the reel bar when the reel bar is in its primary winding position and moved to its secondary winding position.

SUMMARY OF THE INVENTION

In accordance with an aspect of the present invention there is provided a web winding device for winding a substantially continuous web onto a rotating reel bar. The winding device includes a driving drum having an axis about which the drum is rotated. The driving drum maintains a nip driving engagement with the reel bar to drive the rotation of the reel bar and transfer the web passing over a surface of the driving drum onto the reel bar. The web winding device further incudes a transfer arm means for moving the reel bar from a primary winding position where the web begins to wind onto the reel bar to a secondary winding position. The transfer arm means maintains the reel bar in nip driving engagement with the driving drum as the reel bar moves from the primary winding position to the secondary winding position. The web winding device of the present invention is characterized by center wind assist means for applying a driving torque to the reel bar as the reel bar moves from the primary winding position to the secondary winding position. The center assist winding means includes a drive assist support arm, a driving wheel, drive means, transmission means, and tensioning means. The drive assist support arm is pivotally mounted to the transfer arm means to move therewith and pivot relative thereto. The driving wheel is rotatably connected to one end of the drive assist support arm. The drive means and transmission means cooperate to rotatably drive the driving wheel. The tensioning means is connected to the transfer arm means to maintain the driving wheel in driving and torque transfer relation with a peripheral surface portion of the reel bar.

The use of this novel center assist drive mechanism insures that a driving assist is provided by the driving wheel. Further, the use of the driving wheel during the reel bar loading onto the winding device as the winding device moves from the first winding position to the second winding position insures a more distributed nip pressure being applied across the web passing between the reel bar and winding drum during this initial phase of winding.

In a preferred aspect of the present invention, the transfer means includes means for supporting the reel bar above the driving drum and for lowering the reel bar into the primary winding position in nip engagement with the driving drum. The driving wheel of the center wind assist means initially moves into driving and torque transfer relation with the peripheral surface of the reel bar when the transfer means supports the reel bar above the driving drum. The center wind assist means in this pre-winding position acts to start rotation of the reel bar prior to the reel bar being lowered into the first winding position.

BRIEF DESCRIPTION OF THE DRAWINGS

The invention will be better understood and its advantages will become more apparent to those skilled in the art by reference to the following drawings, in conjunction with the accompanying specification, in which.

DETAILED DESCRIPTION OF EMBODIMENTS

Referring to the Figures, there is shown a web winding device or reeling device generally at 10. The winding device includes a driving drum 12 with a continuous web 14 passing thereover. Driving drum 12 forms a nip contact point 16 shown in FIG. 2 between the reel bar 18 and the drum 12.

Figure 1:
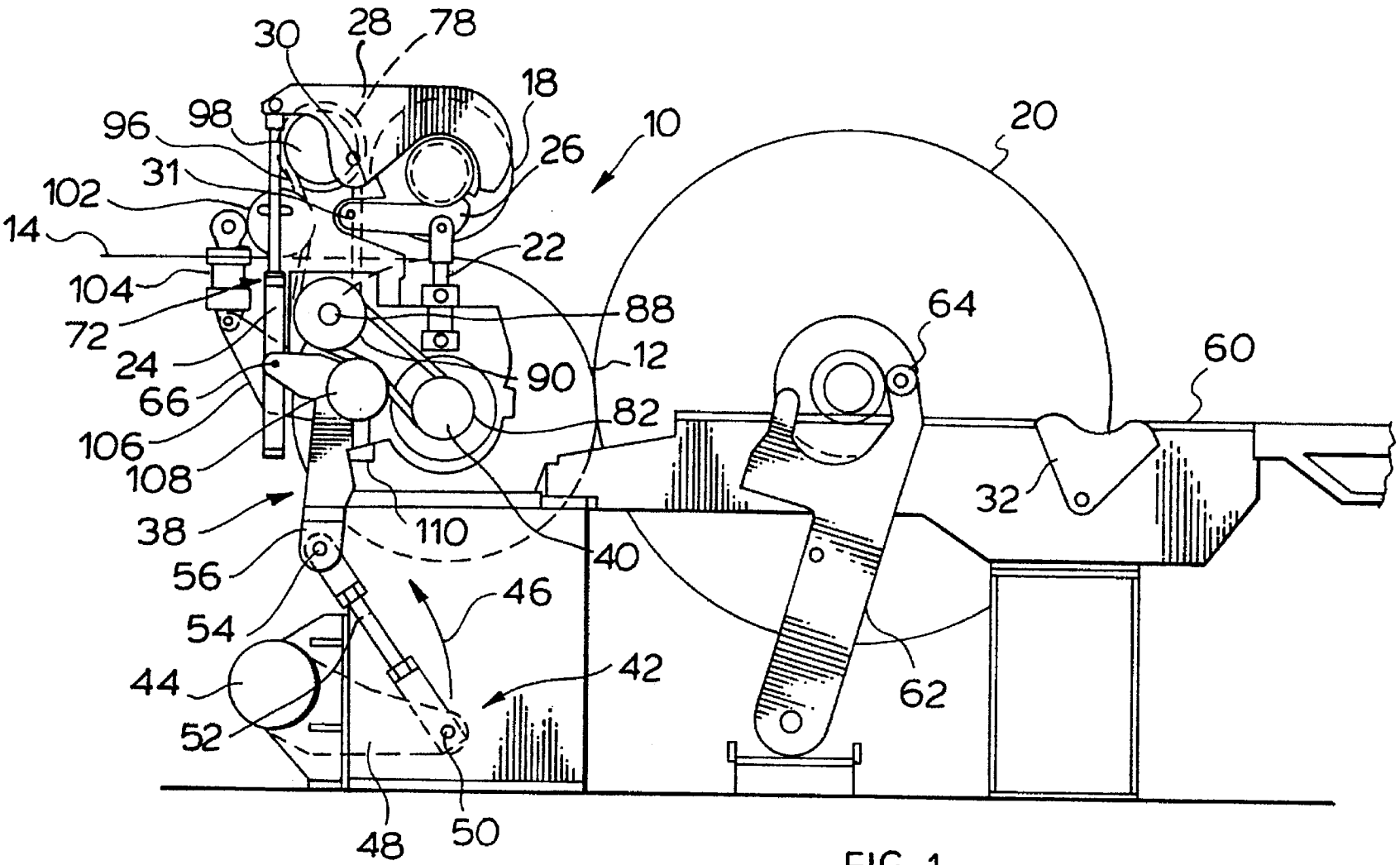
FIG. 1 is a side view of the winding device of the present invention showing the transfer arm mechanism in a reel start up position prior to the reel bar being lowered into the primary winding position.
Figure 2:
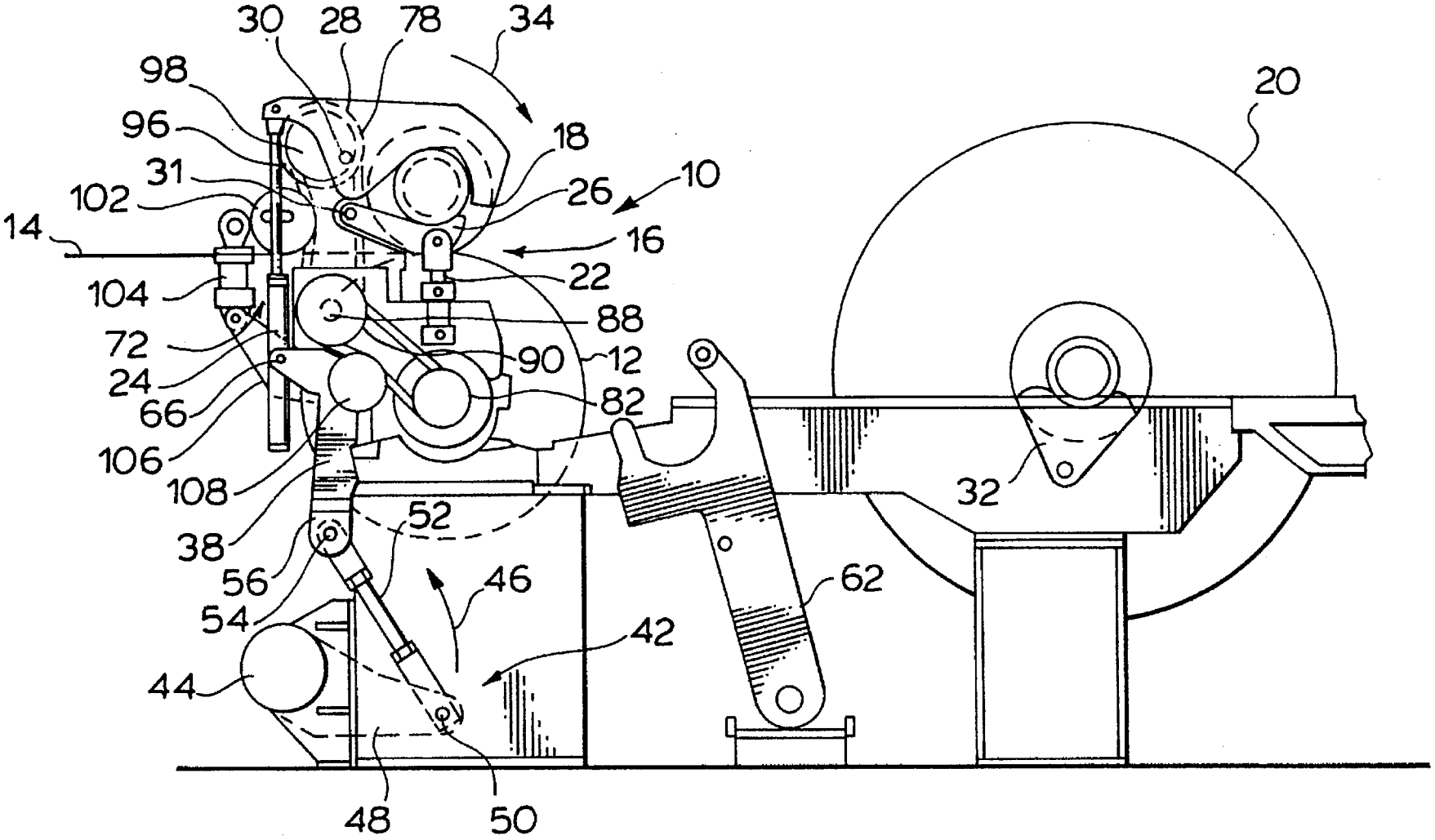
FIG. 2 is a side view of the winding device of the present invention showing the transfer arm mechanism in the primary winding position; and, FIG. 3 is a side view of the winding device of the present invention showing the transfer arm mechanism in the secondary winding position; and, FIG. 4 is an end partial view of the center wind assist means of the web winding device as shown in the start up position of FIG. 1.
Figure 3:
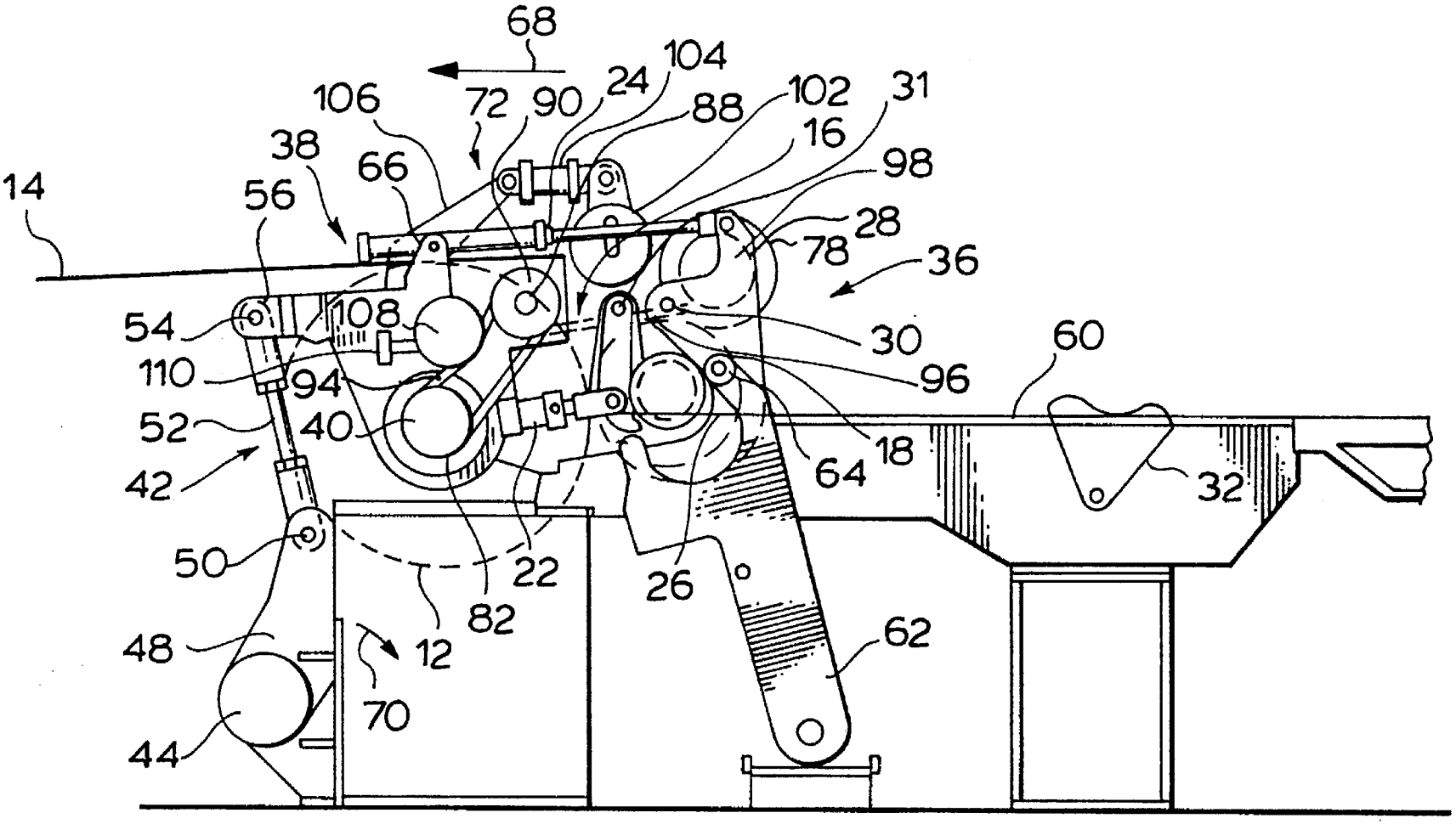

The winding device 10 includes a transfer arm mechanism or means 32 which supports the reel bar 18 in its start up position shown in FIG. 1, in its primary winding position shown in FIG. 2, and as the reel bar moves about drum 12 to the reel bar's secondary winding position shown in FIG. 3. After the reel bar 18 is transferred to the secondary winding position shown in FIG. 3, the secondary support arm 62 engages the reel bar 18 and the transfer arm mechanism 32 is retracted to the position shown in FIG. 1 ready to accept a new reel bar.

The transfer arm means or mechanism 38 includes jaws 26 and 28 which are adapted to clasp or secure the rear bar 18 and support the rear bar 18 as it moves from the start up position to the primary winding position and then to the secondary winding position. The transfer mechanism 38 is mounted to pivot about an axis 40 which is aligned to the center axis of the drum 12 (see FIG. 4). The center axis of the drum 12 is labeled 42.

The rotation of the transfer mechanism 38 is controlled by actuator apparatus comprising a movable linkage 42 and a rotator 44. The rotator 44 preferably comprises a hydraulic actuator which has been referred to as a "rotac". This hydraulic actuator or rotac, if it includes one vane will rotate in a first direction 180° and if it includes two vanes will rotate in a first direction 100°. Through hydraulic means, not shown, this motor is rotated in the direction of arrow 46 (see FIG. 2) approximately 100° to the position shown for the linkage in FIG. 3. The linkage includes a first bracket 48 which is rotatably secured to the hydraulic actuator 44 and has a remote end pivotally connected at 50 to an adjustable linking arm 52. The other end of the adjustable linkage arm 52 is pivotally connected at 54 to flange 56 of the transfer mechanism 38. The hydraulic actuator moves or rotates at a predetermined velocity and a predetermined angular amount. The angular amount again is defined by the number of vanes in the hydraulic actuator and the velocity in which it rotates is determined by the hydraulic pressure involved.

The actuator rotator 44 is connected with an actuator rotator on the other side of the paper winding machine by means of a shaft (not shown). This shaft allows for the actuator apparatus on each side of the paper winding machine to control and synchronize movement of the ends of the reel bar 18 as it is lowered into its secondary position as shown in FIG. 3.

In FIG. 1 the reel bar 18 is in the start up position just before it is lowered into nip engagement with the driving drum 12 to begin winding in the primary winding position. The wound roll 20 is shown in the secondary winding position in nip driving engagement with the driving drum 12. The wound roll is supported on rails 60. The secondary support arm 62 is connected to tensioning means (not shown) to maintain the nip engagement between the drum 12 and wound roll 20.

The lowering of reel bar 18 from its start up position shown in FIG. 1 is controlled by piston cylinder actuating mechanisms 22 and 24 respectively coupled to jaws 26 and 28. Mechanism 22 contracts lowering jaw 26 and piston cylinder mechanism 24 expands allowing upper jaw 28 to drop and pivot about its pivot point 30. This brings the reel 18 into engagement with drum 12 as shown in FIG. 2. At this time web 14 would be cut from the wound roll 20 and wound roll 20 would be moved into the final resting position shown to the right of FIG. 2. A braking mechanism not shown in great detail at 32 would slow the rotation of the drum and wound roll 20 so that this roll could be removed by suitable means such as for example a crane.

Once the reel bar 18 comes into nip engagement with driving drum 12, the reel bar 18 is rotated about the driving drum 12 in the direction shown by arrow 34 by the transfer arm 32. When the reel bar 18 reaches the secondary winding position as shown in FIG. 3 at 36, the reel bar 18 is supported on rails 60. A secondary arm 62 provides a cam surface 64 in contact with the hub of the reel bar 18 to maintain the nip pressure at 16 between drum 12 and reel bar 18. The secondary arm 62 maintains pressure on the reel drum 18 by use of hydraulic actuating members which are not shown.

Next, the piston cylinder mechanism 24, pivotally interconnected between the transfer mechanism 38 at 66, is contracted in the direction of arrow 68. This causes the jaw 28 to pivot about pivot point 30 and release the reel bar 18. Next, the rotator 44 moves in the direction of arrow 70 (see FIG. 3) causing the linkage mechanism to revert to the position shown in FIG. 1. The transfer mechanism 38 is now in a position ready to receive a new reel.

The present invention is characterized in the Figures by a center wind assist mechanism or means 72 which applies driving torque to the reel bar 18 to start up the rotation of the reel bar 18 in the position shown in FIG. 1. The center wind assist mechanism 72 continues to apply driving torque to the reel bar 18 as the transfer arm mechanism 38 moves the reel bar 18 from the primary winding position shown in FIG. 2 to the secondary winding position shown in FIG. 3.

Figure 4:
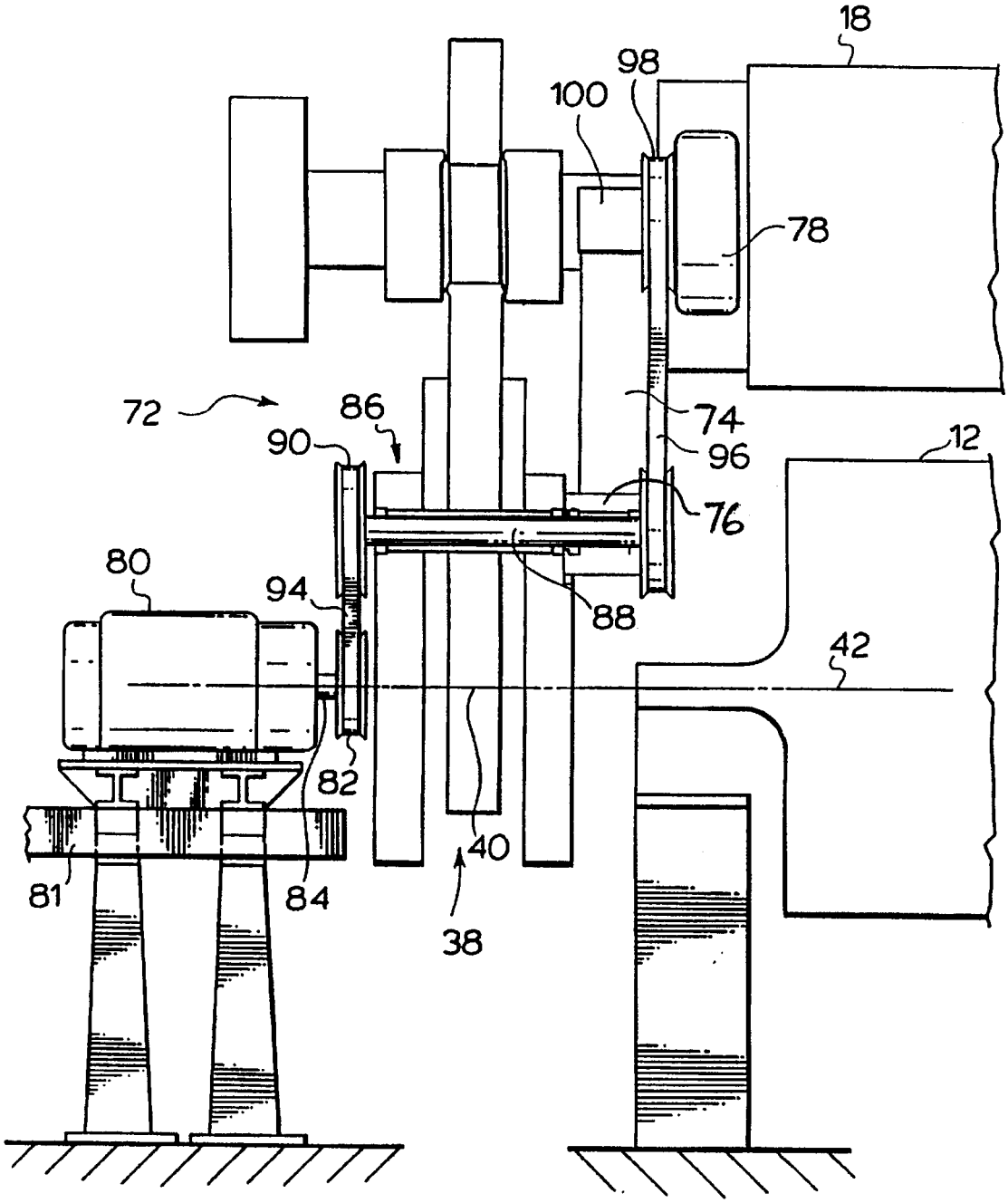

The center wind assist means includes a drive assist support arm 74, as shown in FIG. 4, pivotally mounted to the transfer arm mechanism 38 at point 76. A driving wheel in the form of a tire 78 is rotatably connected at one end to the drive support arm 74. The driving tire 78 engages a peripheral surface of the reel bar 18. It should be understood that in FIG. 4, a gap or space is shown between the reel bar 18 and driving drum 12. This gap represents the distance that the reel bar 18 will be lowered before the reel bar 18 engages the driving drum 12. This, like FIG. 1, FIG. 4 shows the driving tire in driving engagement with the reel bar 18 at start up.

The center wind assist means 72 further includes a drive means or an electric motor 80 whose axis is aligned with the axis 42 of the driving drum 12 allowing the motor 80 to be mounted to non-moving or stationary platform 81. The electric motor 80 has not been shown in FIGS. 1, 2, and 3 for simplification of illustration. The electric motor 80 has a pulley 82 connected to its shaft 84. The pulley 82 forms part of the transmission means 86 which acts to transfer driving torque from motor 80 onto the wheel 78. The transmission means 86 includes a linking and driving shaft 88 that passes through and is journalled in the transfer arm mechanism 38. The linking and driving shaft 88 has a pulley 90 connected at one end thereof and a pulley 92 connected to the opposite end thereof. The transmission means 86 further includes a first belt 94 trained about pulleys 82 and 90. The transmission means 86 further includes a second belt 96 trained about pulley 92 and pulley 98. Pulley 98 is rotatably connected to axial 100 of drive assist support arm 74.

The linking and driving shaft 88 is journalled in the transfer arm mechanism 38 to permit shaft 88 to move with the transfer arm mechanism as it rotates about its center axis 40 when the reel bar 18 is lowered from its primary winding position to its secondary winding position. Because the shaft 88 is journalled in the transfer arm mechanism 38, shaft 88 rotates relative to the transfer arm mechanism 38 and accordingly transfer the torque generated by the electric motor 80 through the belts 94 and 96 to the tire 78 to provide center assist winding driving torque to reel bar 18.

In order to maintain the driving wheel in contact with the reel bar 18, the support arm 74 carries the load of the driving tire 78 and a free wheeling pulley 102 is pushed against the drive belt 96. The pulley 102 is connected through linkage 104 to support arm 106 which is connected to the transfer arm mechanism 38. Further tensioning means is provided by another free wheeling pulley 108 connected directly to the driving means. The tension placed on the belt 94 by pulley 108 is controlled by screw 110.

By providing the tire 78 which contacts the peripheral surface of the reel bar 18, there is provided a positive contact with the reel bar 18 to provide center wind assist drive to the reel bar in the primary winding position and to provide a more even distribution of the winding torque of the reel bar after it comes into driving relation with the driving drum 12.

During operation of the winding device 10, prior to the reel bar 18 coming into contact with the driving drum 12, rotation of the reel bar is started by the center wind assist means 72 engaging the reel bar 18. The center wind assist means 72 brings the speed of rotation of the reel bar up to a speed that allows the reel bar to be lowered onto the driving drum and take up the web. The center wind assist means 72 moves with the transfer arm mechanism 38 and continues to assist in the driving of the reel bar 18 as the reel bar 18 is moved from the primary winding position to the secondary winding position.

It should be understood that the drawings illustrate one side of a paper machine and that complimentary structure is preferably provided on the other side of the paper machine.

What is claimed is:

1. A web winding device for winding a substantially continuous web onto a rotating reel bar, said winding device including:

a) a driving drum having an axis about which said drum is rotated, said driving drum maintaining a nip driving engagement with said reel bar to drive rotation of said reel bar and transfer the web passing over a surface of said driving drum onto said reel bar;

b) transfer arm means for moving said reel bar from a primary winding position, where the web begins to wind onto said reel bar, to a secondary winding position, said transfer arm means maintaining said reel bar in nip driving engagement with said driving drum as said reel bar moves from the primary winding position to the secondary winding position; and, c) center wind assist means for applying a driving torque to said reel bar as said reel bar moves from the primary winding position to the secondary winding position, comprising:

(i) a drive assist support arm pivotally mounted to said transfer arm means to move therewith and pivot relative thereto, (ii) a driving wheel rotatably connected to one end of said drive assist support arm, (iii) drive means for rotatably driving transmission means, and said transmission means for rotatably driving said driving wheel, said drive means including a motor having a driving shaft, and said transmission means including a linking and driving shaft passing through said transfer arm means and journalled therewith, a first belt means interconnecting said motor driving shaft and said linking and driving shaft, and a second belt means interconnecting said linking and driving shaft with said driving wheel, and (iv) tensioning means, connected to said transfer arm means, for maintaining said driving wheel in driving and torque transfer relation with a peripheral surface portion of said reel bar.

2. The web winding device of claim 1 wherein said driving wheel is a tire.

3. The web winding device of claim 1 wherein said drive means driving shaft is aligned with the axis of said driving drum.

4. The web winding device of claim 1 wherein said transfer arm means includes means for supporting said reel bar above said driving drum and for lowering said reel bar into the primary winding position in nip engagement with said driving drum, the driving wheel of said center wind assist means initially moving into driving and torque transfer relation with the peripheral surface of said reel bar to start rotation of the reel bar when said transfer arm means supports the reel bar above the driving drum.

5. The web winding device of claim 1 wherein said drive assist support arm is pivotally mounted to said linking and driving shaft of said transmission means.

6. The web winding device of claim 1 wherein said tensioning means further includes a first pulley moveable against said second belt means to maintain said driving wheel in driving and torque transfer relation with a peripheral surface portion of said reel bar.

7. The web winding device of claim 6 wherein said tensioning means further includes a second pulley moveable against said first belt means to maintain tension on said first belt means.

* * * * *